US006901825B1

(12) United States Patent
Lebron

(10) Patent No.: US 6,901,825 B1
(45) Date of Patent: Jun. 7, 2005

(54) E-Z SHUTTER CRANK

(75) Inventor: Victor L. Lebron, Indian Harbour Beach, FL (US)

(73) Assignee: Vicmar Solutions, Inc., Indian Harbor Beach, FL (US)

( * ) Notice: Subject to any disclaimer, the term of this patent is extended or adjusted under 35 U.S.C. 154(b) by 0 days.

(21) Appl. No.: 10/751,158

(22) Filed: Jan. 2, 2004

(51) Int. Cl.[7] ..... B25B 13/00
(52) U.S. Cl. ..... 81/124.2; 81/176.15; 81/176.2
(58) Field of Search ..... 81/121.1, 124.2, 81/176.1, 176.15, 176.2, 52, 53.1; D8/14, D8/26, 27, 29

(56) References Cited

U.S. PATENT DOCUMENTS

| | | | | |
|---|---|---|---|---|
| 1,765,362 A | | 6/1930 | Berry | |
| 2,435,480 A | | 2/1948 | Tuttle | 279/2 |
| 3,011,813 A | | 12/1961 | Arneson | 287/124 |
| 4,357,845 A | | 11/1982 | Cornia | 81/125 |
| 4,724,731 A | * | 2/1988 | Onofrio | 81/119 |
| 4,846,244 A | | 7/1989 | Rosenfeld | 160/201 |
| 4,984,489 A | | 1/1991 | Krauthamer | 81/124.2 |
| D329,795 S | * | 9/1992 | Bird et al. | D8/70 |
| 5,216,781 A | | 6/1993 | Brondfield | 16/114 R |
| D358,082 S | | 5/1995 | Trezza | D8/70 |
| 5,433,850 A | * | 7/1995 | Murray | 210/361 |
| D402,517 S | * | 12/1998 | Gracia et al. | D8/29 |
| 6,010,154 A | * | 1/2000 | Payne et al. | 280/766.1 |
| 6,095,016 A | * | 8/2000 | Lam | 81/121.1 |
| 6,171,033 B1 | | 1/2001 | Wrobel | 408/239 R |
| 6,382,885 B2 | | 5/2002 | Isaksson | 408/239 A |
| 6,477,924 B1 | * | 11/2002 | Talbot | 81/124.2 |
| 6,558,089 B2 | | 5/2003 | DeBlasio | 408/239 A |
| 6,626,068 B2 | * | 9/2003 | McKivigan | 81/124.2 |
| 6,715,384 B1 | * | 4/2004 | Kozak | 81/124.2 |

* cited by examiner

*Primary Examiner*—David B. Thomas
(74) *Attorney, Agent, or Firm*—Brian S. Steinberger; Law Offices of Brian S. Steinberger, P.A.

(57) ABSTRACT

Extension rod tools and method of using the tools for allowing power tools such as power drills and power screw drivers and socket wrenches to be able to open and/or close crank handles on windows and/or shutters. The novel tools can have flat sided ends that can attach to the power tools or socket wrenches, and have second opposite ends that fit over a raised t-shaped pin on the crank handle to the window/shutter. The second end of the rod tools can have a pair of opposite located slots that lock onto the t-shaped pins so that twisting the rod tools locks the rod tools to the crank handle. The slots can include clockwise oriented curved slots. The slots can include counter clockwise oriented curved slots. The slots can include oval shapes. The slots can include t-shapes. The rod tools can have a length of approximately 12 to approximately 18 inches or greater and a diameter of approximately ½ to approximately 1 inch, and be formed from a single piece of material, such as metal, or plastic, or composite or combinations thereof, and the like.

17 Claims, 13 Drawing Sheets

10
20
22
24
25
26
28
30
40
42
2B
2C
2E 110
120
122
124
125
126
128
130
140
142
7B
7C
7D
7E
7F 70
71
72
74
78
110
R2
124

70
71
72
74
70
78
125
I2
110
100
122
124

210
220
222
224
225
226
228
230
240
242
10B
10C
10D
10E
10F 310
320
322
324
326
328
330
340
342
300
13B
13C
13D
13E
13F

E-Z SHUTTER CRANK

This invention relates to windows and storm shutters and in particular to an extension rod tool devices and methods of use to allow power tools and socket wrenches to automatically open a close existing elevated window type shutters that have T shaped and crossed pins in their crank knob.

BACKGROUND AND PRIOR ART

Elevated window and storm shutters are known to have built in shutter cranks that require long extended hand crank arms, that require a user to grip the shutter crank, and manually rotate the long extended arm to open and close the shutters. The manual action can be both tedious, time consuming, and difficult to most users. As a result, often the hand crank arms are not used, and the shutters remain in either constantly open or closed positions.

Various tools have been proposed over the years that can be attached to and be used for extending the reach of power tools. See for example, U.S. Pat. No. 1,765,362 to Berry; U.S. Pat. No. 3,011,813 to Arneson; U.S. Pat. No. 4,357,845 to Cornia; Des. 358,082 to Trezza; U.S. Pat. No. 6,171,033 to Wrobel; U.S. Pat. No. 6,382,885 to Isaksson; and U.S. Pat. No. 6,558,089 to DeBlasio. However, none of these devices has been described for use with crank arms on shutters and windows. In addition, these patented devices would not be able to be used with T-shaped control knobs used on elevated shutter type windows.

U.S. Pat. No. 4,984,489 to Krauthamer describes a "window handle turning accessory", title, that can attach to a power drill. However, this device requires an enlarged cylindrical housing with a rear conical section that is separately attached to a smaller diameter shank, the latter of which is attached to the power tool, FIGS. 2, 3, 4. The accessory has one long side slit 30/31 FIG. 2, or two opposite long side slits 52, 54 for fitting over, a round handle knob, FIG. 3 or over a double wing(butterfly) knob, FIG. 4. Other enlarged heads in the remaining figures having cylindrical openings that fit over cylindrical splined portions of window handles, FIGS. 5–9.

The Krauthamer accessories would require the user loosely fit the enlarged heads of the accessory over the knobs without locking the knob to the accessory. Thus, the Krauthamer accessories can potentially disengage and fall off the knobs during use.

Furthermore, the Krauthamer accessories would not be practical or easy or inexpensive to manufacture due to the enlarged head which must require separate machining and molding before it can be attached to a shank for use with a power tool.

In addition, the Krauthamer accessories would not be able to be used with cross positioned and T-shaped pins that are used on cranks of elevated window shutters since their heads would not fit thereon, and would not be able to lock onto T-shaped pins on the cranks of elevated window shutters. Furthermore, the short shank lengths in the Krauthamer accessories are not long enough to be used with elevated shutter windows.

Thus, the need exists for solutions to the problems with the prior art.

SUMMARY OF THE INVENTION

A primary objective of the present invention is to provide an extension rod tool and method of using the extension rod tool with power drills and power screw drivers, that can automatically crank open and crank closed an elevated window type shutter having a crank handle having cross shaped and T-shaped pins.

A secondary objective of the present invention is to provide an extension rod tool and method of using the extension rod tool with power drills and power screw drivers, that can automatically lock onto and easily be released from crank handles having cross shaped and T-shaped pins used on elevated window type shutters.

A third objective of the present invention is to provide an extension rod tool and method of using the extension rod tool with elevated window type shutters having a crank handle having cross shaped and T-shaped pins, that is inexpensive to manufacture and use.

Embodiments of the invention can include novel rod shaped members having a flat sided end such as a hexagon shaped perimeter end that can be inserted into an adjustable chuck head of a conventional power tool(battery, cordless or powercord), such as a electric drill, electric screw driver, and the like. The opposite end of the novel rod shaped member can include an adapter head end having an opening with opposite facing slit slots so that the adapter end can fit over a tip of a window/shutter crank handle and existing sideway protruding pins on the crank handle can pass through the side slits and lock into curved slots by rotating the rod shaped member.

A first embodiment can have a pair of clockwise oriented curved slots on opposite sides of the rod shaped member having a lower case b-shaped configuration. Twisting the rod counter-clockwise locks the rod to the crank handle.

A second embodiment can have a pair of counter-clockwise oriented curved slots on opposite sides of the rod shaped member having a backward lower case b-shaped configuration. Twisting the rod clockwise locks the rod to the crank handle.

A third embodiment can have a pair of t-shaped curved slots on opposite sides of the rod shaped member. Twisting the rod either clockwise or counter clockwise locks the rod to the crank handle.

A fourth embodiment can have a pair of oval shaped curved slots on opposite sides of the rod shaped member. Twisting the rod either clockwise or counter clockwise locks the rod to the crank handle.

The rod members can be easily removed by slightly twisting the rod members and pulling the rod members from the crank handle.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

First Embodiment

Figure 1:
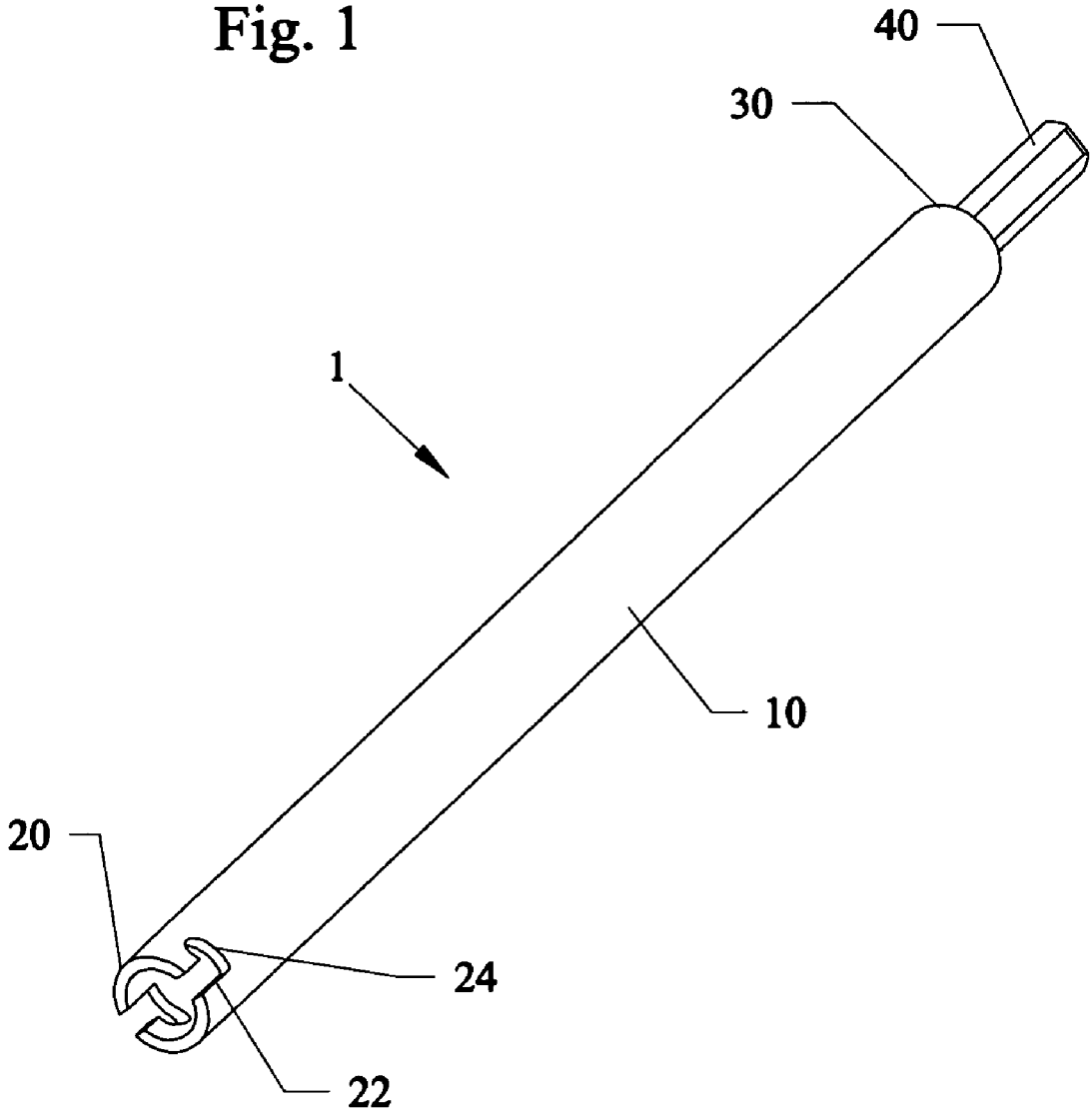
FIG. 1 is a perspective right side view of a first preferred embodiment of a crank extension rod with flat sided tool head end and crank end having clockwise oriented curved slots.
Figures 2A, 2B, 2C, 2D, 2E, 2F:
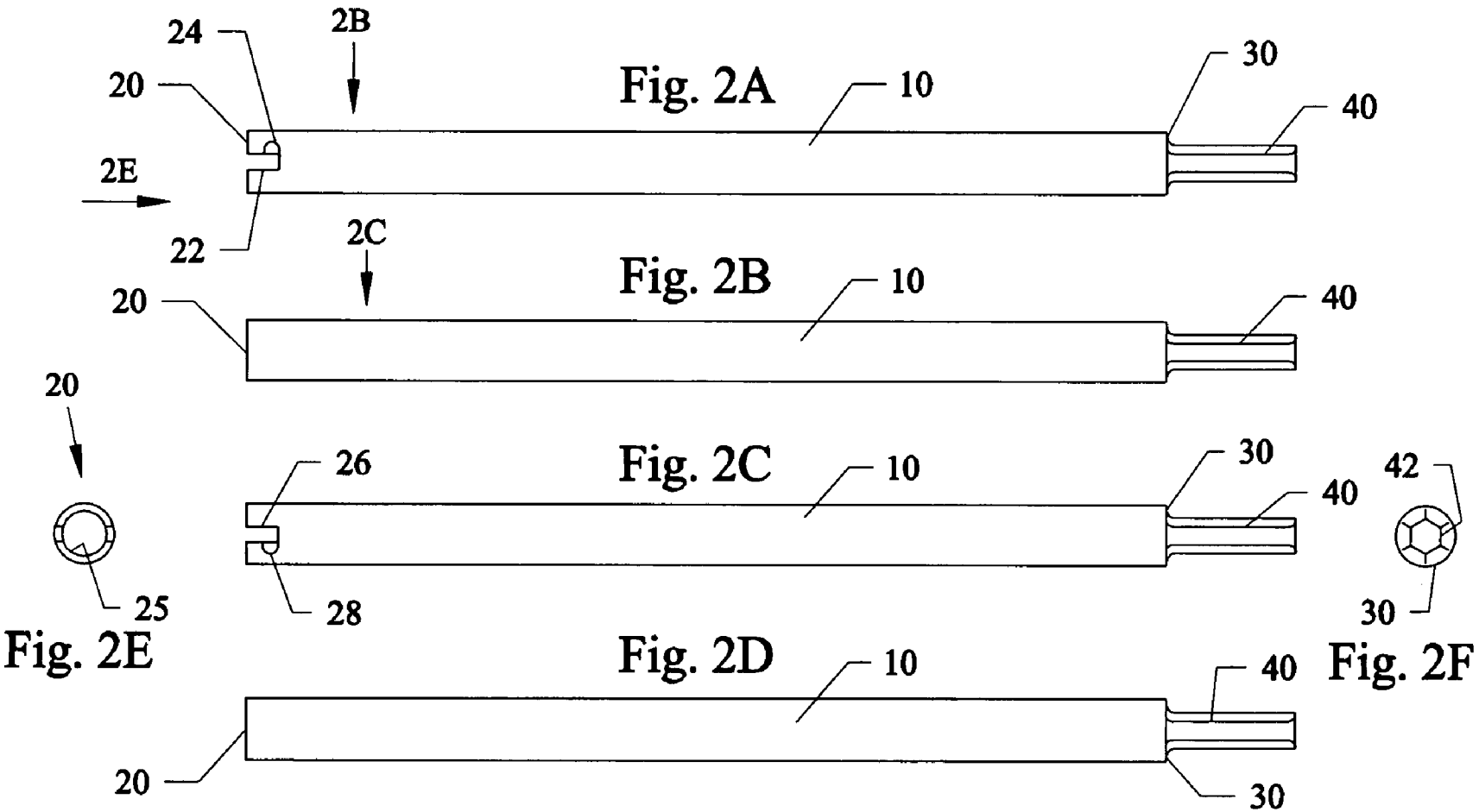
FIG. 2A is a right side view of the crank extension rod of FIG. 1.
FIG. 2B is a top side view of the crank extension rod of FIG. 2A along arrow 2B.
FIG. 2C is a left side view of the crank extension rod of FIG. 2B along arrow 2C.
FIG. 2D is a bottom side view of the crank extension rod of FIG. 2C along arrow 2D.
FIG. 2E is a rear end view of the crank extension rod of FIG. 2A along arrow 2E.
FIG. 2F is a front end view of the crank extension rod of FIG. 2A along arrow 2F.

FIG. 1 is a perspective right side view of a first preferred embodiment of a crank extension rod 1 with flat sided tool head end 40 and crank end 20 having clockwise oriented curved slots 22, 24, 26, 28. FIG. 2A is a right side view of the crank extension rod 1 of FIG. 1. FIG. 2B is a top side view of the crank extension rod 1 of FIG. 2A along arrow 2B. FIG. 2C is a left side view of the crank extension rod 1 of FIG. 2B along arrow 2C. FIG. 2D is a bottom side view of the crank extension rod 1 of FIG. 2C along arrow 2D. FIG. 2E is a rear end view of the crank extension rod 1 of FIG. 2A along arrow 2E. FIG. 2F is a front end view of the crank extension rod 1 of FIG. 2A along arrow 2F.

Referring to FIGS. 1–2F, extension rod 1 can include a cylindrical tubular portion 10 having a length of approximately 12 to approximately 18 inches or greater and a tubular diameter of approximately ½ inch to approximately 1 inch. Extending from a front end 30 of the cylindrical mid portion 10 of extension rod 1 can be a narrower diameter protruding portion 40 having flat sides 42 that can have a hexagon perimeter shape. The opposite end 20 of the cylindrical tubular portion 10 can include a hollowed out opening 25 and a pair of oppositely facing clockwise oriented curved cut-out slots 22, 24, 26, 28 in the sides of cylindrical tubular portion 10 that can each have a generally lower case b-shape configuration. The slot width openings can be approximately 3⁄16 of an inch for a tight fit, and up to approximately ¼ inch for a loose fit.

Figure 3A:
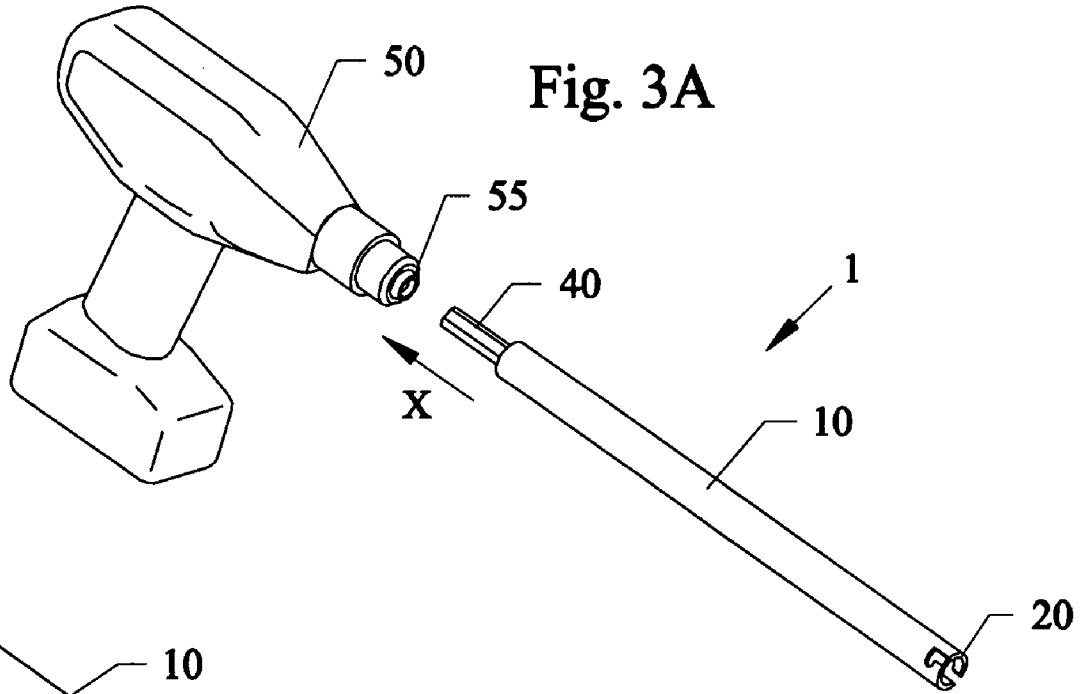
FIG. 3A is a perspective view of the crank extension rod of the preceding figures separated from a power tool.
Figure 3B:
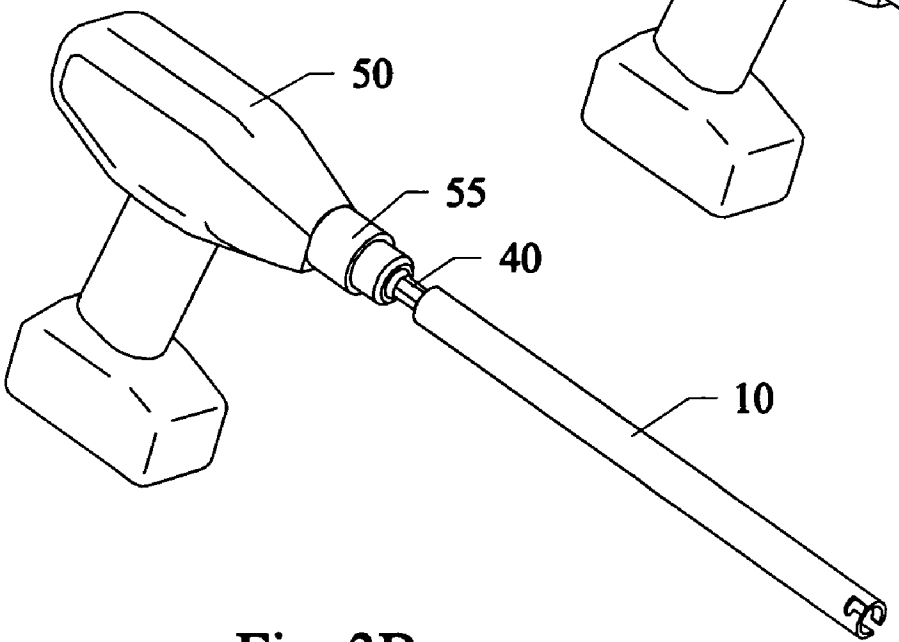
FIG. 3B is another view of the crank extension rod of the preceding figures attached to the power tool.

FIG. 3A is a perspective view of the crank extension rod 1 of the preceding figures separated from and about to be moved in the direction of arrow X to the adjustable head of a power tool 50. FIG. 3B is another view of the crank extension rod 1 of the preceding figures attached to the power tool 50. A conventional handheld power tool 50 such as but not limited to an electrical power drill, a power screw driver, and the like, having an adjustable chuck head 55 can be used to lock about the flat sided faces 42 of the protruding portion 40 of the novel extension rod 1.

Figure 5A:
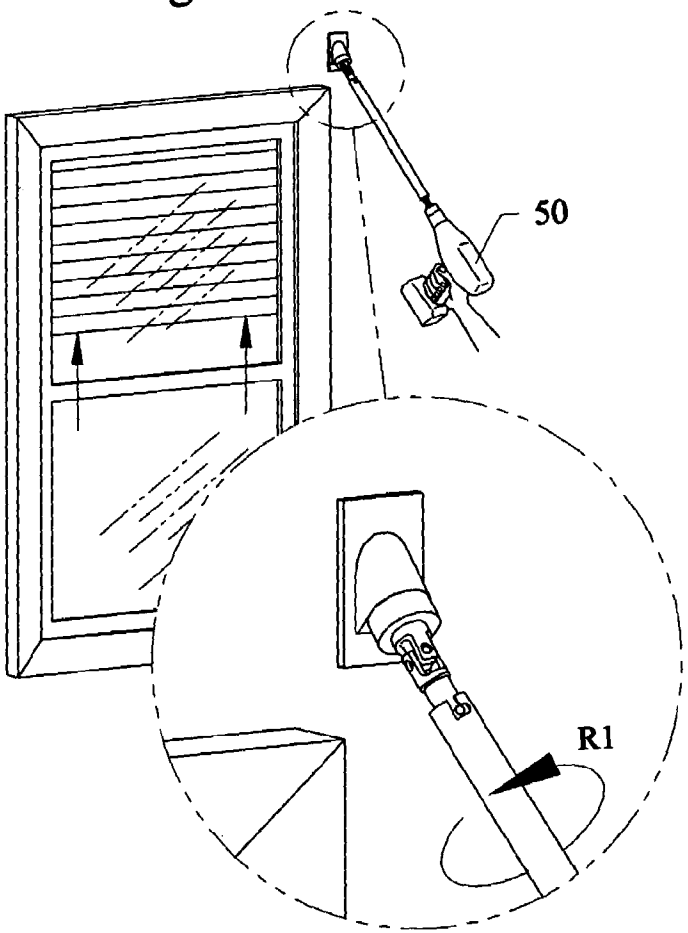
FIG. 5A shows the power tool with attached crank extension rod of the preceding figures positioned attached to the perpendicular pins on the crank handle of the window/shutter.
Figure 4A:
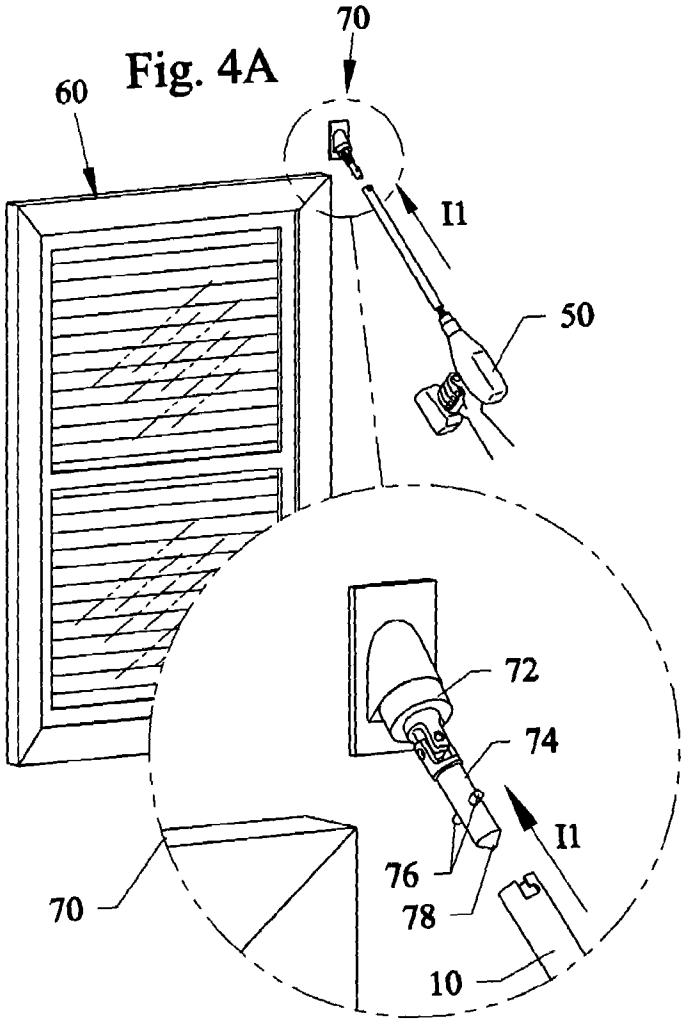
FIG. 4A shows the power tool with attached crank extension rod of FIG. 3B about to be attached to crank handle on a window/shutter.
Figure 5B:
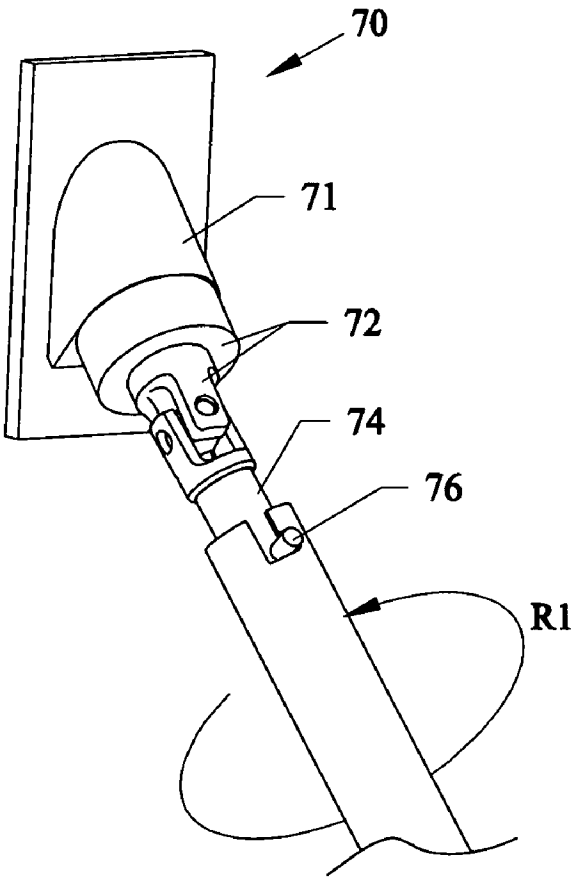
FIG. 5B is an enlarged view of FIG. 5A showing the crank extension rod attached to the perpendicular pins on the crank handle of the window/shutter.
Figure 4B:
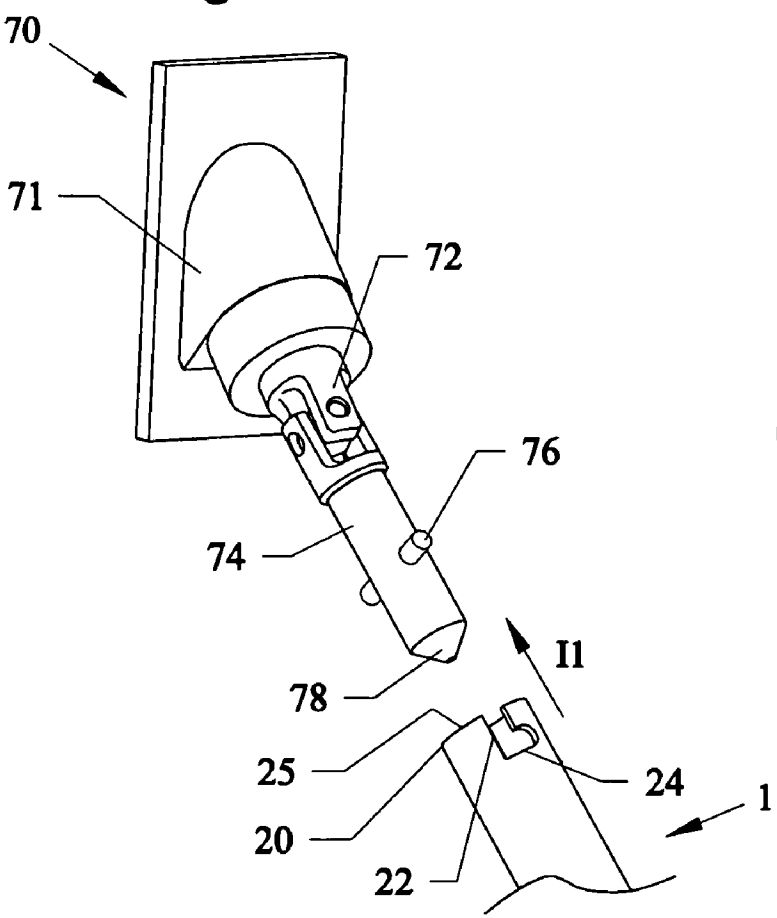
FIG. 4B is an enlarged view of FIG. 4A showing the crank extension rod about to be attached to the perpendicular pins on the crank handle of the window/shutter.

FIG. 4A shows the power tool 50 with attached crank extension rod 1 of FIG. 3B about to be attached to a conventional crank handle 70 on a window/shutter 60. FIG. 4B is an enlarged view of FIG. 4A showing the crank extension rod 1 about to be attached to the perpendicular pins 76 on the crank handle 70 of the window/shutter 60. The pins 76 in this conventional crank handle 70 are generally perpendicular to shaft portion 74 forming a generally T-shaped configuration. The shaft portion 74 can be attached by a pivot member to a base 72 that can rotate within a stationary base 71 in the crank handle 70. FIG. 5A shows the power tool 50 with attached crank extension rod 1 of the preceding figures after being slipped over the tip 78 and perpendicular pins 76 on the crank handle 70 of the window/shutter 60. FIG. 5B is an enlarged view of FIG. 5A showing the crank extension rod 1 attached to and locked onto the pins 76 on the crank handle 70 of the window/shutter 60.

Referring to FIGS. 1–5B, opening 25 of end 20 of extension rod 1 can be moved in the direction of arrow I1 to slip over tip portion 78 of crank handle 70 and allow pins 76 to pass through the vertical slot cut-out portions 22, 26 in the end 20 of the rod 1 until the pins 76 abut against wall portions in the horizontal slot cut-out portions 24, 28. The extension rod 1 is then locked to the pins 76 of the crank handle 70 by twisting the extension rod in a counter-clockwise direction as shown by arrow R1 until the pins 76 abut against other wall portions in the slots. A user can then turn on the power tool 50 to rotate in a counter clockwise direction allowing the shaft 74 of the crank handle 70 to open the shutter/window 60. To close the shutter/window 60, the power tool 50 can be switched to rotate the rod 1 in a clockwise direction allowing the shutter/window to be closed. When finished the user can easily twist the rod 1 by the power tool 50 to pull off and remove the rod 1 from the crank handle 70.

Second Embodiment

Figure 6:
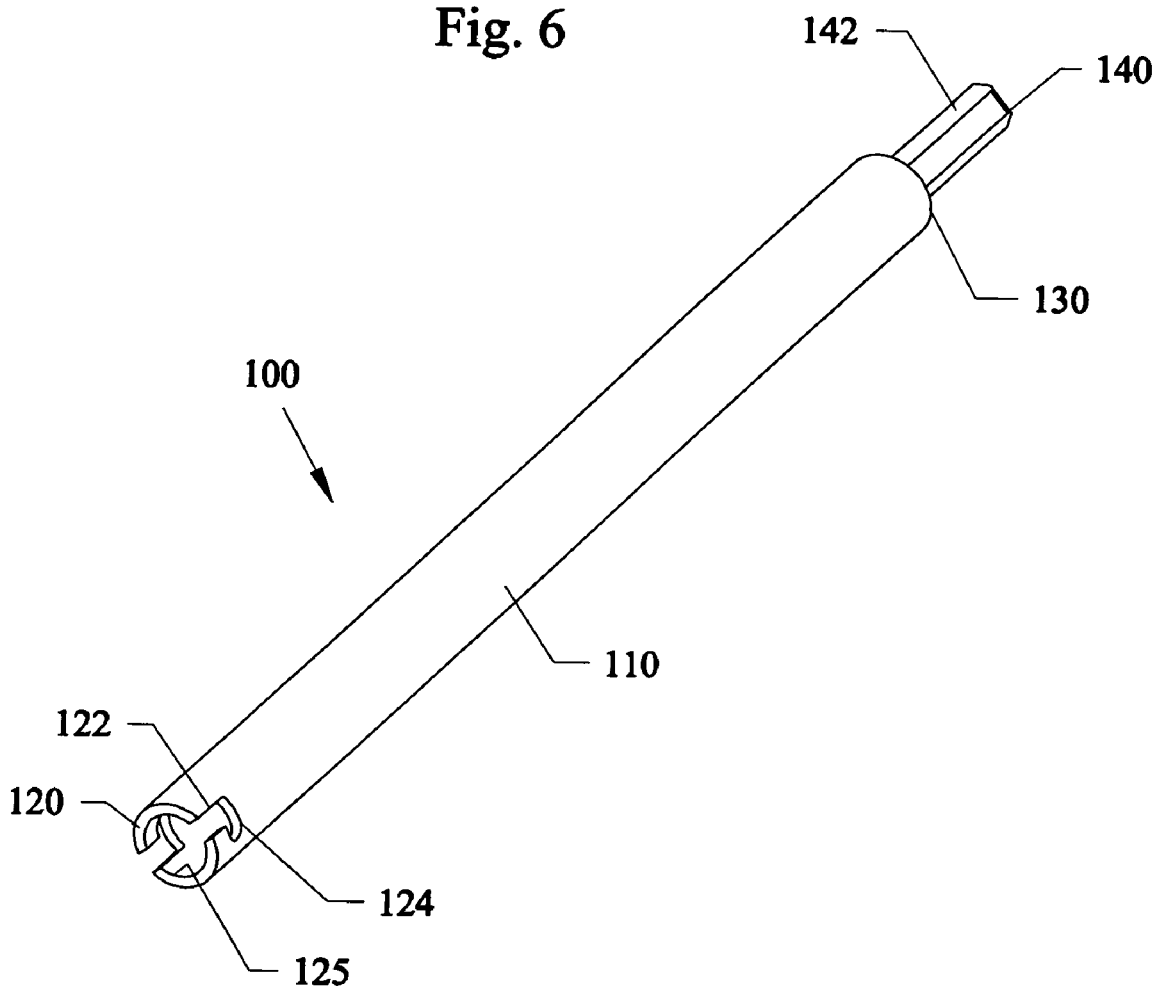
FIG. 6 is a perspective right side view of a second preferred embodiment of a crank extension rod with flat sided tool head end and crank end having counter-clockwise oriented curved slots.
Figures 7A, 7B, 7C, 7D, 7E, 7F:
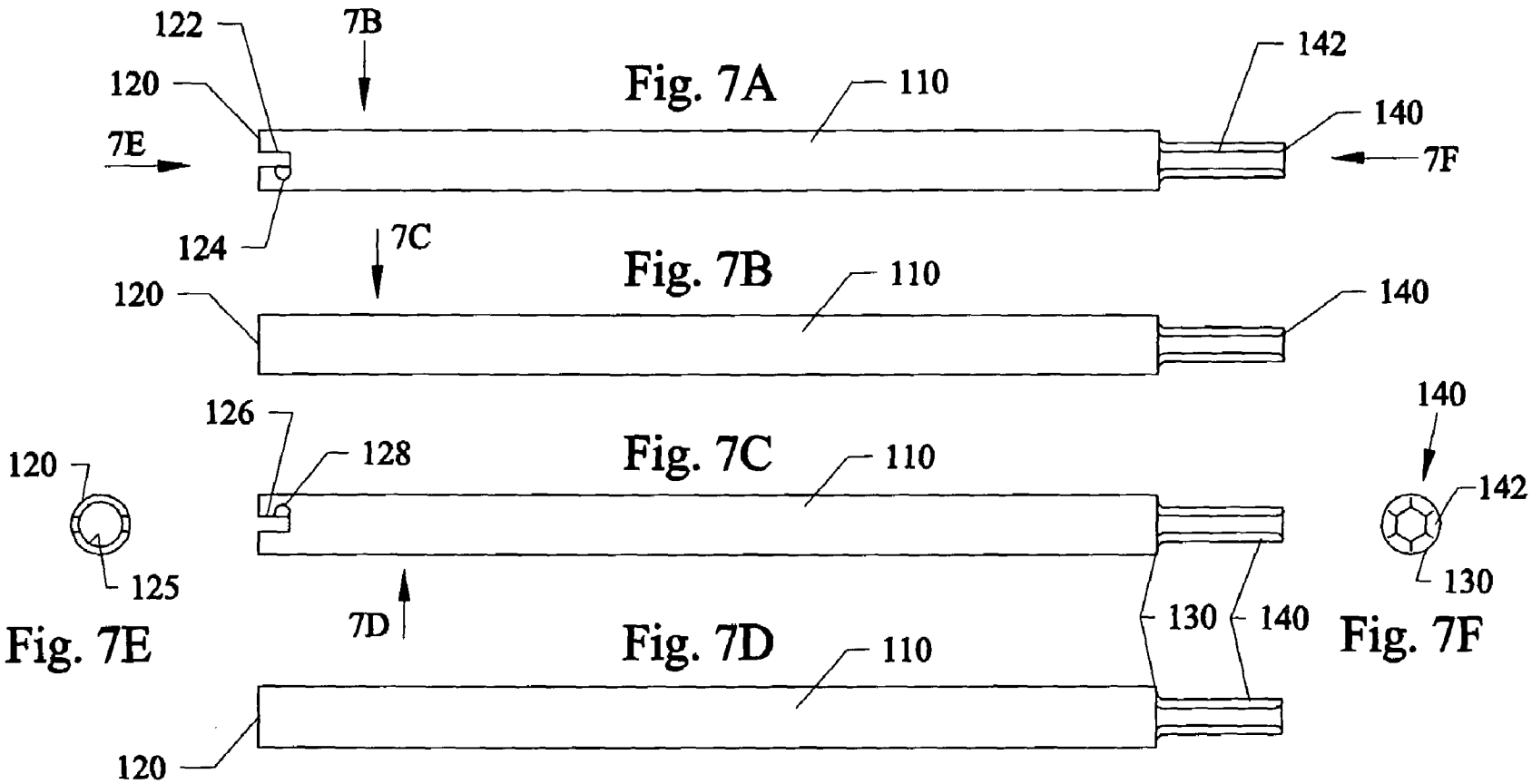
FIG. 7A is a right side view of the crank extension rod of FIG. 6.
FIG. 7B is a top side view of the crank extension rod of FIG. 7A along arrow 2B.
FIG. 7C is a left side view of the crank extension rod of FIG. 7B along arrow 7C.
FIG. 7D is a bottom side view of the crank extension rod of FIG. 7C along arrow 7D.
FIG. 7E is a rear end view of the crank extension rod of FIG. 7A along arrow 7E.
FIG. 7F is a front end view of the crank extension rod of FIG. 7A along arrow 7F.

FIG. 6 is a perspective right side view of a second preferred embodiment of a crank extension rod 100 with flat sided tool head end 140 and crank end 120 having counter-clockwise oriented curved slots 122, 124, 126, 128. FIG. 7A is a right side view of the crank extension rod 100 of FIG. 6. FIG. 7B is a top side view of the crank extension rod 100 of FIG. 7A along arrow 2B. FIG. 7C is a left side view of the crank extension rod 100 of FIG. 7B along arrow 7C. FIG. 7D is a bottom side view of the crank extension rod 100 of FIG. 7C along arrow 7D. FIG. 7E is a rear end view of the crank extension rod 100 of FIG. 7A along arrow 7E. FIG. 7F is a front end view of the crank extension rod 100 of FIG. 7A along arrow 7F.

Referring to FIGS. 6–7F, the second embodiment crank rod 100 can include a cylindrical tubular portion 110 having a length of approximately 12 to approximately 18 inches or greater and a tubular diameter of approximately ½ inch to approximately 1 inch. Extending from a front end 130 of the cylindrical mid portion 110 of extension rod 100 can be a narrower diameter protruding portion 140 having flat sides 142 that can have a hexagon perimeter shape. The opposite end 120 of the cylindrical tubular portion 110 can include a hollowed out opening 125 and a pair of oppositely facing counter-clockwise oriented curved cut-out slots 122, 124, 126, 128 in the sides of cylindrical tubular portion 110 that can each have a generally lower case backward b-shape configuration. The slot width openings can be approximately 3/16 of an inch for a tight fit, and up to approximately ¼ inch for a loose fit.

Figures 8A, 8B:
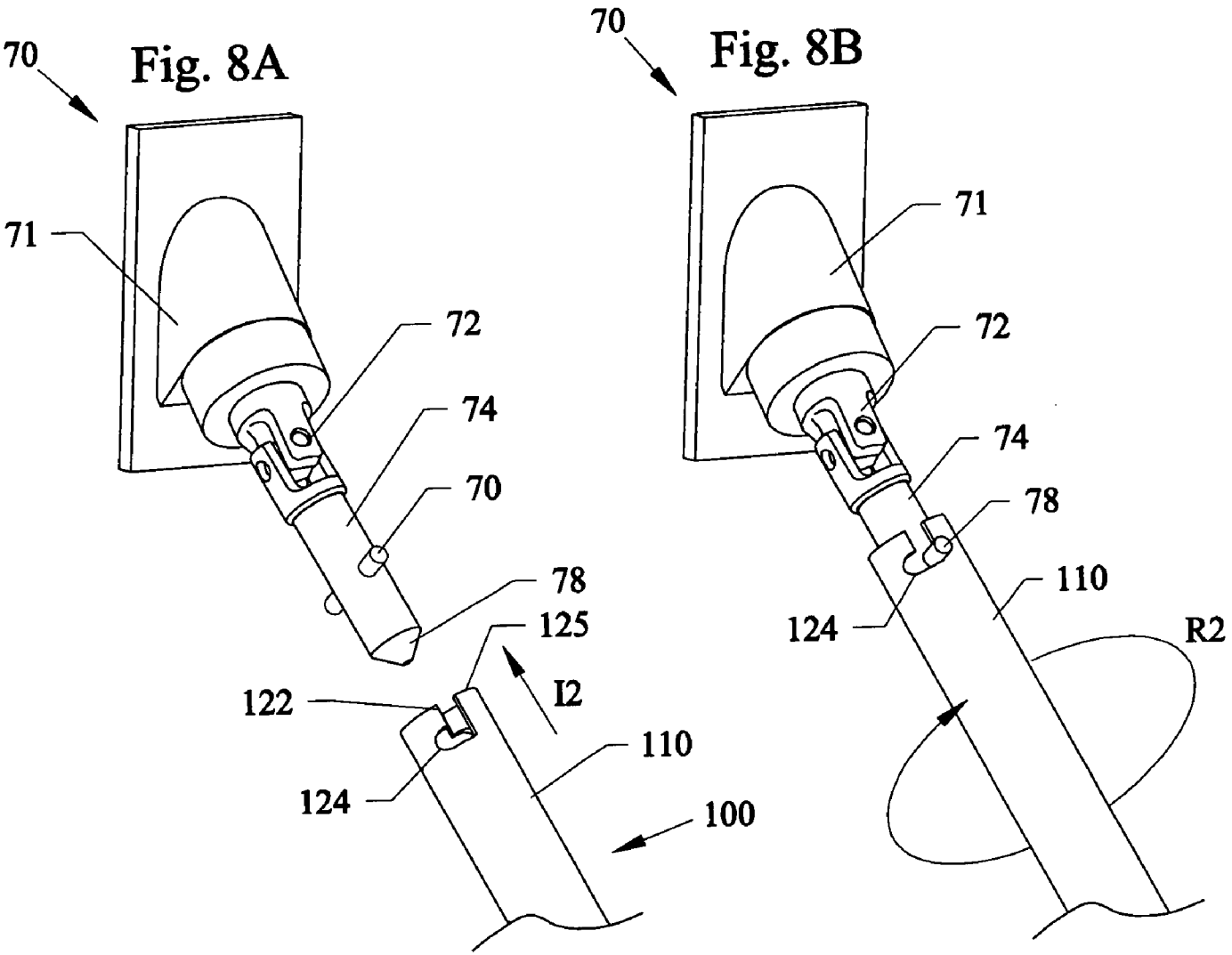
FIG. 8A is an enlarged view of a power tool attached crank rod of the second embodiment about to be attached to the crank handle of the window/shutter.
FIG. 8B is another view of FIG. 8A with the crank rod attached to the crank handle.

FIG. 8A is an enlarged view of a power tool attached crank rod 100 of the second embodiment about to be attached to the crank handle 70 of the window/shutter. FIG. 8B is another view of FIG. 8A with the crank rod 100 attached to the crank handle 70. Referring to FIGS. 6–8B, a power tool 50(such as that shown in FIGS. 3A–3B can be attached to the protruding portion 140 in a manner similar to the first embodiment described above.

Next, opening 125 of end 120 of extension rod 100 can be moved in the direction of arrow 12 to slip over tip portion 78 of crank handle 70 and allow pins 76 to pass through the vertical slot cut-out portions 122, 126 in the end 120 of the rod 100 until the pins 76 abut against a wall portion in the horizontal slot cut-out portions 124, 128. The extension rod 100 is then locked to the pins 76 of the crank handle 70 by twisting the extension rod in a clockwise direction as shown by arrow R2 until the pins 76 abut against another wall portion in the slots. A user can then turn on the power tool 50 to rotate in a clockwise direction allowing the shaft 74 of the crank handle 70 to close the shutter/window 60(shown in FIGS. 4A, 5A). To open the shutter/window 60, the power tool 50 can be switched to rotate the rod 1 in a counter-clockwise direction allowing the shutter/window to be opened. When finished the user can easily twist the rod 100 by the power tool 50 to pull off and remove the rod 100 from the crank handle 70.

Third Embodiment

Figure 9:
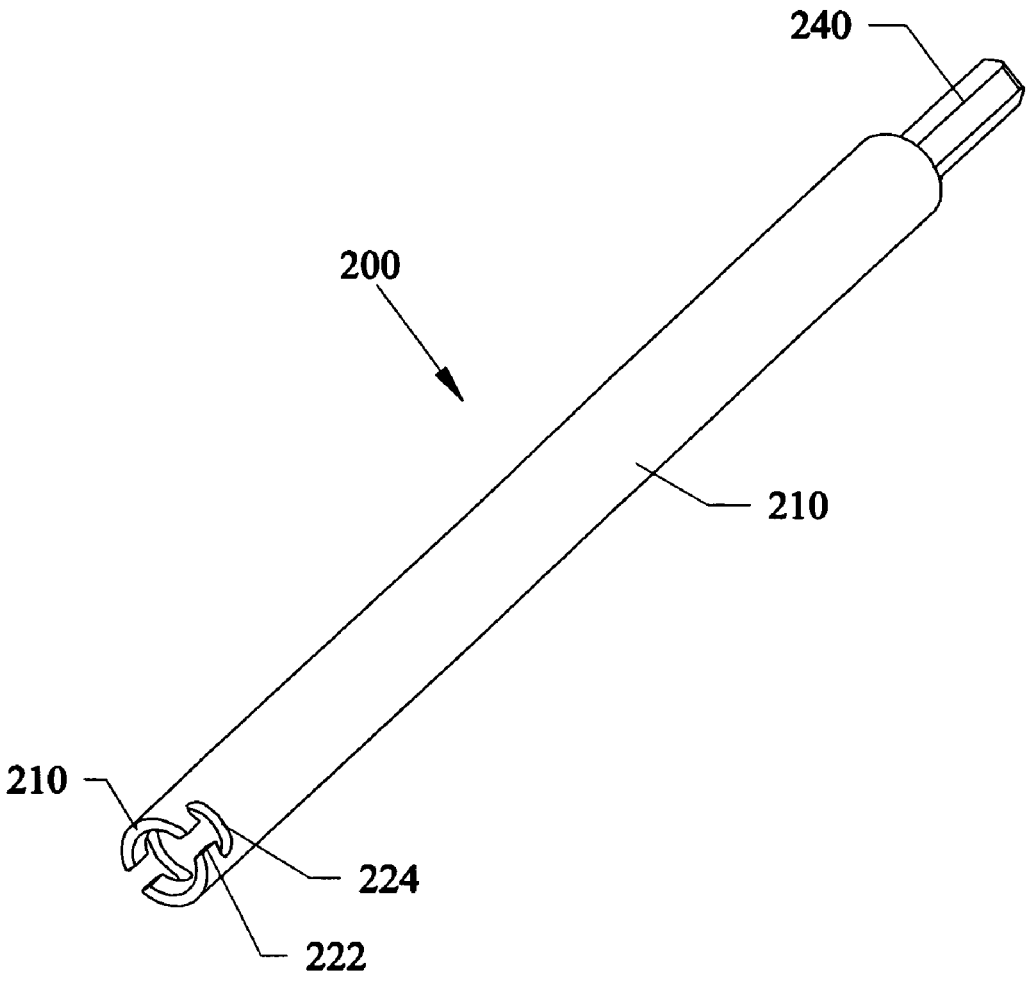
FIG. 9 is a perspective right side view of a third preferred embodiment of a crank extension rod with flat sided tool head end and crank end having t-shaped curved slots.
Figures 10A, 10B, 10C, 10D, 10E, 10F:
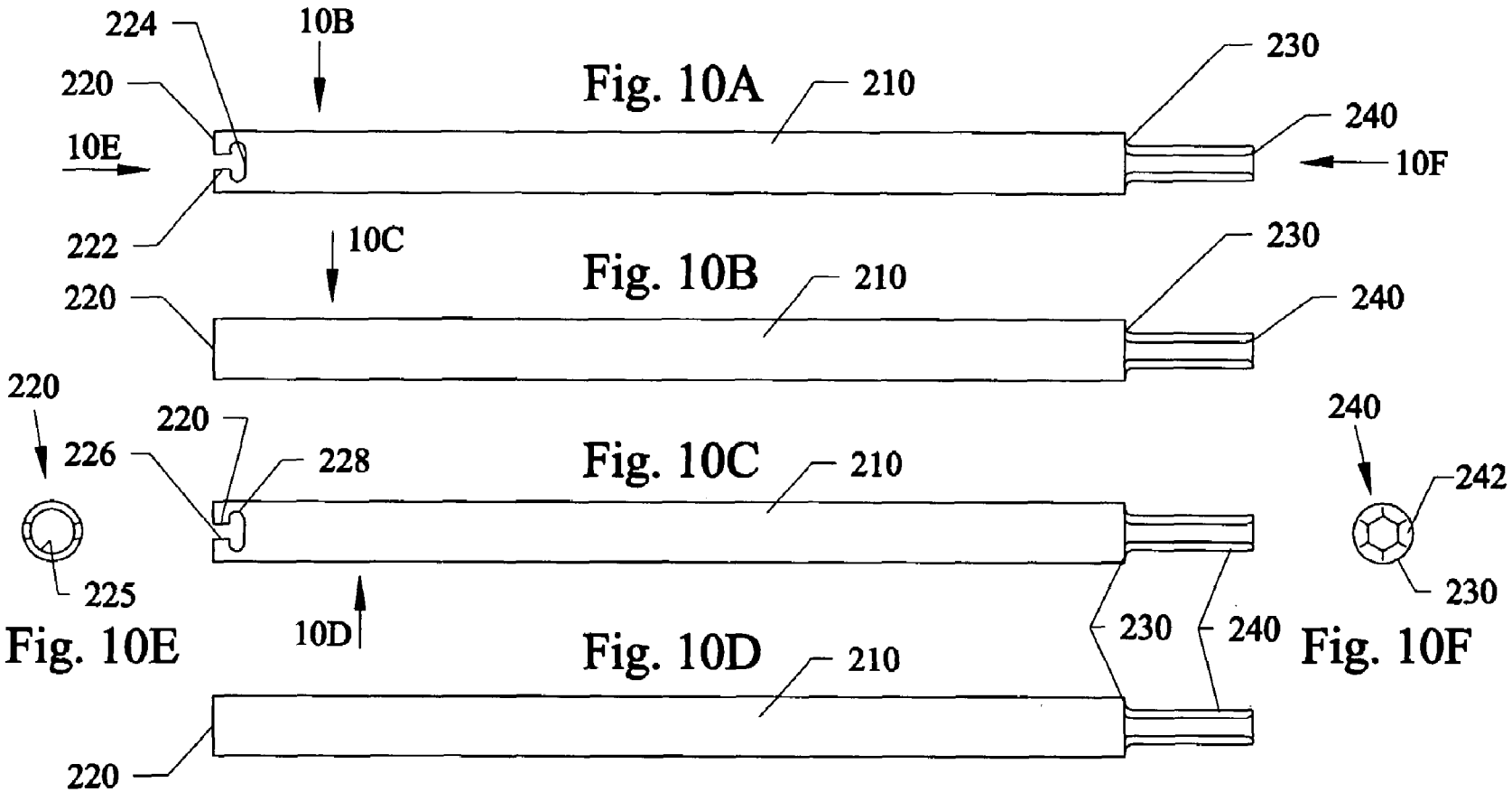
FIG. 10A is a right side view of the crank extension rod of FIG. 9.
FIG. 10B is a top side view of the crank extension rod of FIG. 10A along arrow 10B.
FIG. 10C is a left side view of the crank extension rod of FIG. 10B along arrow 10C.
FIG. 10D is a bottom side view of the crank extension rod of FIG. 10C along arrow 10D.
FIG. 10E is a rear end view of the crank extension rod of FIG. 10A along arrow 10E.
FIG. 10F is a front end view of the crank extension rod of FIG. 10A along arrow 10F.

FIG. 9 is a perspective right side view of a third preferred embodiment of a crank extension rod 200 with flat sided tool head end 240 and crank end 220 having t-shaped curved slots 222, 224, 226, 228. FIG. 10A is a right side view of the crank extension rod 200 of FIG. 9. FIG. 10B is a top side view of the crank extension rod 200 of FIG. 10A along arrow 10B. FIG. 10C is a left side view of the crank extension rod 200 of FIG. 10B along arrow 10C. FIG. 10D is a bottom side view of the crank extension rod 200 of FIG. 10C along arrow 10D. FIG. 10E is a rear end view of the crank extension rod 200 of FIG. 10A along arrow 10E. FIG. 10F is a front end view of the crank extension rod 200 of FIG. 10A along arrow 10F.

Referring to FIGS. 9–10F, the third embodiment crank rod 200 can include a cylindrical tubular portion 210 having a length of approximately 12 to approximately 18 inches or greater and a tubular diameter of approximately ½ inch to approximately 1 inch. Extending from a front end 230 of the cylindrical mid portion 210 of extension rod 200 can be a narrower diameter protruding portion 240 having flat sides 242 that can have a hexagon perimeter shape. The opposite end 220 of the cylindrical tubular portion 210 can include a hollowed out opening 225 and a pair of oppositely facing t-shaped curved cut-out slots 222, 224, 226, 228 in the sides of cylindrical tubular portion 210. The slot width openings can be approximately 3/16 of an inch for a tight fit, and up to approximately ¼ inch for a loose fit.

Figure 11B:
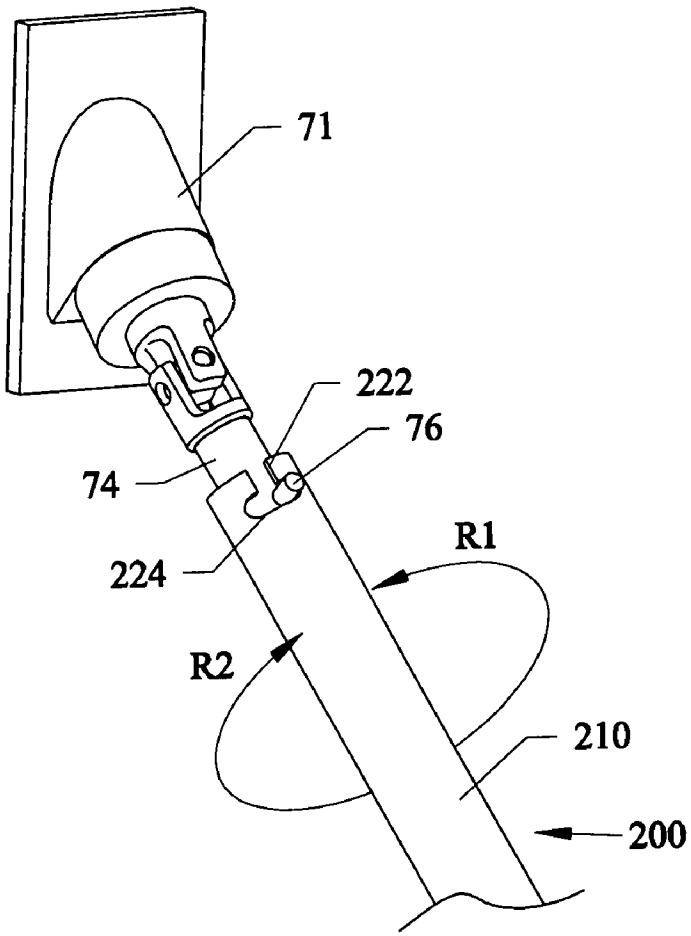
FIG. 11B is another view of FIG. 11A with the crank rod attached to the crank handle.
Figure 11A:
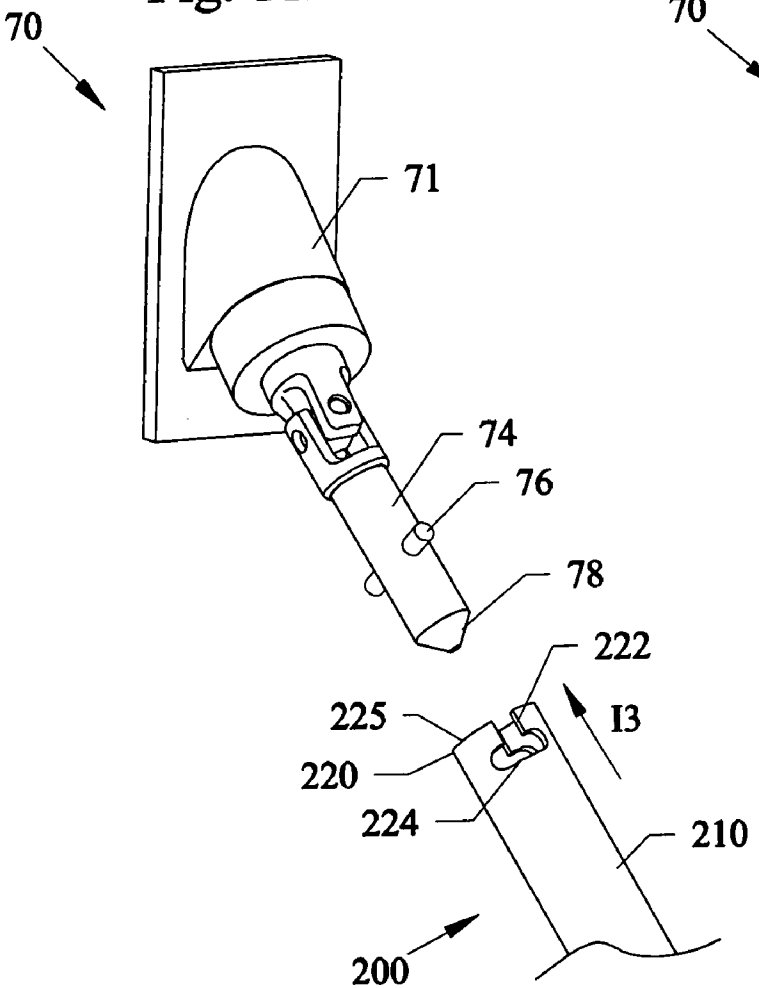
FIG. 11A is an enlarged view of a power tool attached crank rod of the third embodiment about to be attached to the crank handle of the window/shutter.

FIG. 11A is an enlarged view of a power tool attached crank rod 200 of the third embodiment about to be attached to the crank handle 70 of the window/shutter 60. FIG. 11B is another view of FIG. 11A with the crank rod 200 attached to the crank handle 70. Referring to FIGS. 9–11B, a power tool 50(such as that shown in FIGS. 3A–3B can be attached to the protruding portion 240 in a manner similar to the first embodiment described above.

Next, opening 225 of end 220 of extension rod 200 can be moved in the direction of arrow 13 to slip over tip portion 78 of crank handle 70 and allow pins 76 to pass through the vertical slot cut-out portions 222, 226 in the end 220 of the rod 200 until the pins 76 abut against a wall portion in the horizontal slot cut-out portions 224, 228. The extension rod 200 is then locked to the pins 76 of the crank handle 70 by twisting the extension rod in a counter-clockwise direction as shown by arrow R1 or in a clockwise direction as shown by arrow R2 until the pins 76 abut against other wall portions in the slots. A user can then turn on the power tool 50 to rotate in a clockwise direction allowing the shaft 74 of the crank handle 70 to close the shutter/window 60(shown in FIGS. 4A, 5A). To open the shutter/window 60, the power tool 50 can be switched to rotate the rod 1 in a counter-clockwise direction allowing the shutter/window to be opened. When finished the user can easily twist the rod 200 by the power tool 50 to pull off and remove the rod 200 from the crank handle 70.

Fourth Embodiment

Figure 12:
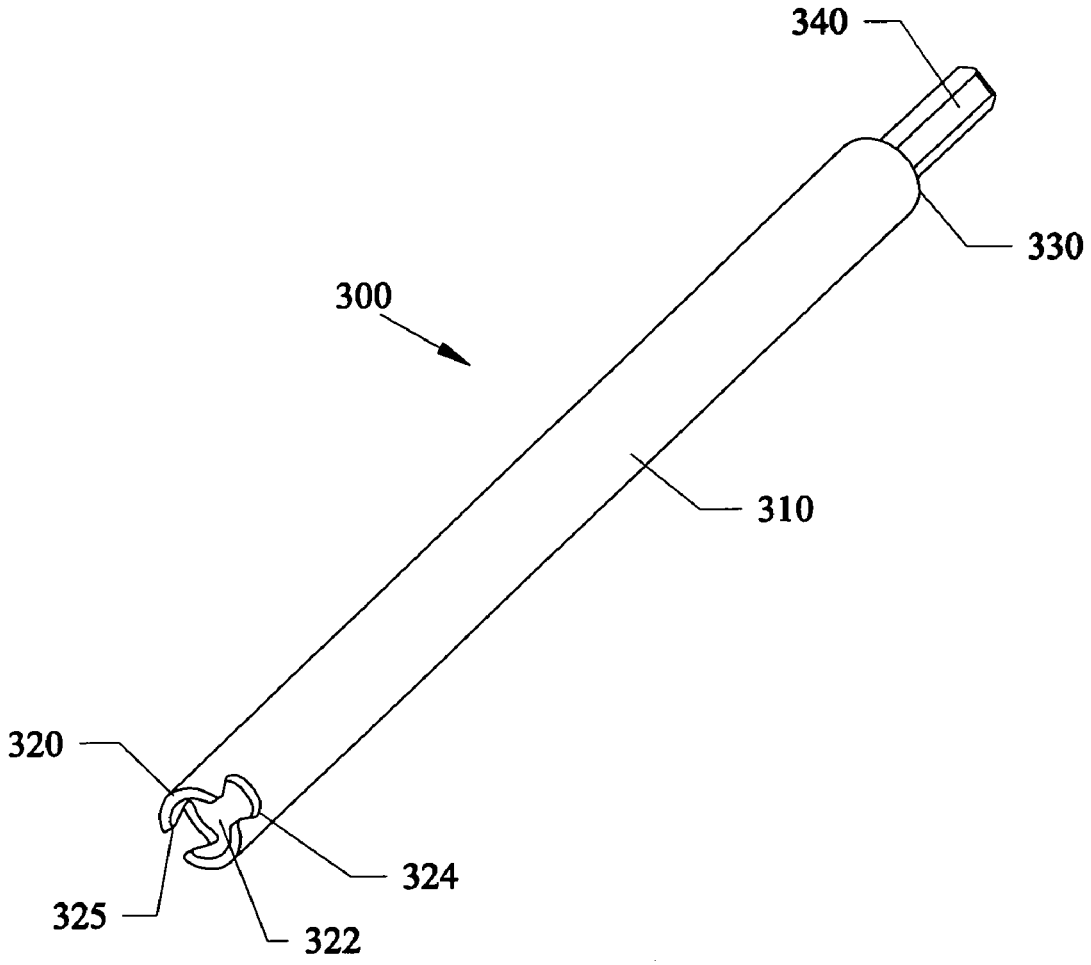
FIG. 12 is a perspective right side view of a fourth preferred embodiment of a crank extension rod with flat sided tool head end and crank end having oval-shaped curved slots.
Figures 13A, 13B, 13C, 13D, 13E, 13F:
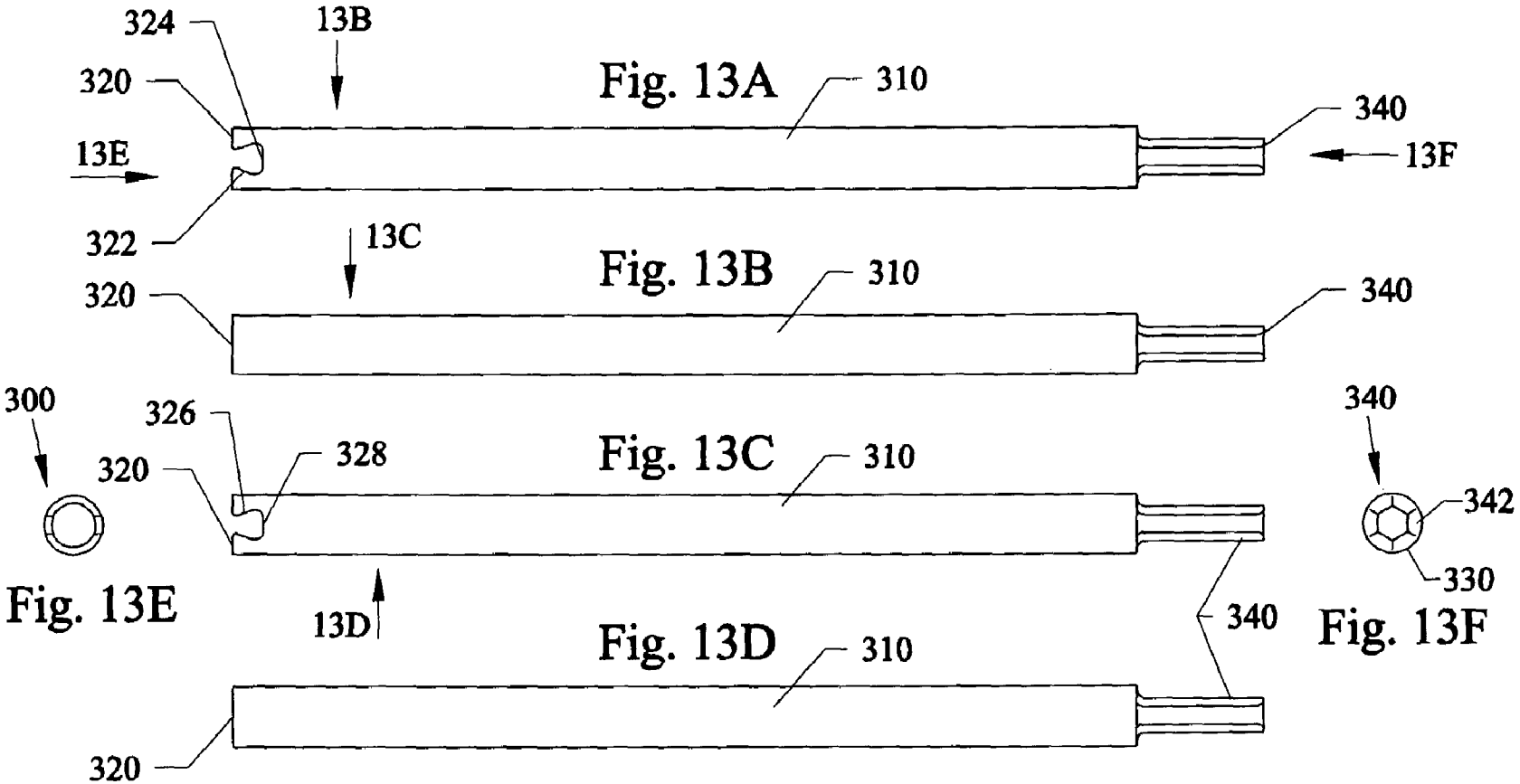
FIG. 13A is a right side view of the crank extension rod of FIG. 12.
FIG. 13B is a top side view of the crank extension rod of FIG. 13A along arrow 13B.
FIG. 13C is a left side view of the crank extension rod of FIG. 13B along arrow 13C.
FIG. 13D is a bottom side view of the crank extension rod of FIG. 13C along arrow 13D.
FIG. 13E is a rear end view of the crank extension rod of FIG. 13A along arrow 13E.
FIG. 13F is a front end view of the crank extension rod of FIG. 13A along arrow 13F.

FIG. 12 is a perspective right side view of a fourth preferred embodiment of a crank extension rod 300 with flat sided tool head end 340 and crank end 320 having oval-shaped curved slots 322, 324, 326, 328. FIG. 13A is a right side view of the crank extension rod 300 of FIG. 12. FIG. 13B is a top side view of the crank extension rod 300 of FIG. 13A along arrow 13B. FIG. 13C is a left side view of the crank extension rod 300 of FIG. 13B along arrow 13C. FIG. 13D is a bottom side view of the crank extension rod 300 of FIG. 13C along arrow 13D. FIG. 13E is a rear end view of the crank extension rod 300 of FIG. 13A along arrow 13E. FIG. 13F is a front end view of the crank extension rod 300 of FIG. 13A along arrow 13F.

Referring to FIGS. 12–13F, the fourth embodiment crank rod 300 can include a cylindrical tubular portion 310 having a length of approximately 12 to approximately 18 inches or greater and a tubular diameter of approximately ½ inch to approximately 1 inch. Extending from a front end 330 of the cylindrical mid portion 310 of extension rod 300 can be a narrower diameter protruding portion 340 having flat sides 342 that can have a hexagon perimeter shape. The opposite end 320 of the cylindrical tubular portion 310 can include a hollowed out opening 325 and a pair of oppositely facing oval shaped curved cut-out slots 326, 328 having stem cut-out portions 322, 324, in the sides of cylindrical tubular portion 310. The fourth embodiment can operate and function in a similar manner to the third embodiment described above. The slot width openings can be approximately 3/16 of an inch for a tight fit, and up to approximately ¼ inch for a loose fit.

While the invention has been described for use with window type shutters, the invention can be applicable to storm shutters, hurricane shutters, security shutters, safety shutters, rollup and roll down shutters, and the like.

The novel tool rod members can be formed from stainless steel, aluminum, plastic, combinations thereof, and the like. The tool rod can be formed from other materials such as plastics, graphite, composites, combinations thereof, and the like.

The novel tool rod members can be formed from a single cylindrical member with one end crimped into a shank portion for being attached to a power tool. Alternatively, the tool rod members can have other cross-sectional shape exteriors other than cylindrical, and can include square, rectangular, triangular, hexagon, and the like.

While the invention has been described for use with window type shutters, the invention can be applicable to storm shutters, hurricane shutters, security shutters, safety shutters, rollup and roll down shutters, and the like.

Although the preferred embodiments describe using the novel extension rod with power tools, the invention can be used with socket wrenches, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A tool for opening and closing windows or shutters having crank knobs with T-shaped pin knobs, comprising:

an elongated member having a first end adapted to be attached to one of a power tool and a socket wrench, and a second end;

an adapter head attached to the second end of the elongated member having a pair of opposite facing clockwise oriented lower-case b shaped slots adapted for engaging the T-shaped pins on a crank knob of a window or a shutter, so that the window or the shutter is opened and closed by the tool.

2. The tool of claim 1, wherein the elongated member includes:

an elongated length of at least approximately 12 inches long; and a diameter of approximately ½ to approximately 1 inch.

3. The tool of claim 2, wherein the adapter head includes:

an opening for fitting over the T-shaped pins on the crank knob.

4. The tool of claim 1, wherein the adapter head and the elongated member include:

a single elongated rod.

5. The tool of claim 4, wherein the single elongated rod includes: a cylindrical shape.

6. The tool of claim 1, wherein the first end of the elongated member includes:

a flat sided protruding portion extending from the elongated member.

7. The tool of claim 6, wherein the flat sided protruding portion includes:

a hexagon shaped perimeter.

8. A method of opening and closing a shutter and window having a crank handle with t-shaped pins, comprising the steps of:

providing an adapter head having a pair of opposite facing same directing facing and oriented lower-case b shaped slots attaching one end of an extension rod to a separate tool selected from one of a power tool and a socket wrench;

overlapping an opening of the adapter head in an opposite second end of the extension rod about the t-shaped pin crank handle of the window or the shutter;

twisting the rod so that the t-shaped pins lock into the pair of slots that are perpendicular to the opening in the second end of the rod; and rotating the rod with the separate tool to open or close the shutter or the window.

9. The method of claim 8, further comprising the step of:

orienting the pair of a pair of lower-case b shaped slots in a clockwise direction and orientation.

10. The method of claim 8, further comprising the step of:

orienting the pair of a pair of lower-case b shaped slots in a counter-clockwise direction and orientation.

11. A tool for opening and closing windows or shutters having crank knobs with T-shaped pin knobs, comprising:

an elongated member having a first end adapted to be attached to one of a power tool and a socket wrench, and a second end;

an adapter head attached to the second end of the elongated member having a pair of opposite facing counter-clockwise oriented lower-case b shaped slots adapted for engaging the T-shaped pins on a crank knob of a window or a shutter, so that the window or the shutter is opened and closed by the tool.

12. The tool of claim 11, wherein the elongated member includes:

an elongated length of at least approximately 12 inches long; and a diameter of approximately ½ to approximately 1 inch.

13. The tool of claim 12, wherein the adapter head includes:

an opening for fitting over the T-shaped pins on the crank knob.

14. The tool of claim 11, wherein the adapter head and the elongated member include:

a single elongated rod.

15. The tool of claim 14, wherein the single elongated rod includes: a cylindrical shape.

16. The tool of claim 10, wherein the first end of the elongated member includes:

a flat sided protruding portion extending from the elongated member.

17. The tool of claim 16, wherein the flat sided protruding portion includes:

a hexagon shaped perimeter.

* * * * *